US005523005A

United States Patent [19]

Di Biase et al.

[11] Patent Number: 5,523,005

[45] Date of Patent: Jun. 4, 1996

[54] GEAR LUBRICANT COMPOSITION

[75] Inventors: Stephen A. Di Biase, Euclid; Curtis R. Scharf, Wickliffe; James J. Schwind, Willowick; Craig D. Tipton, Perry, all of Ohio

[73] Assignee: The Lubrizol Corporation, Wickliffe, Ohio

[21] Appl. No.: 313,630

[22] Filed: Sep. 27, 1994

Related U.S. Application Data

[63] Continuation of Ser. No. 579,182, Sep. 5, 1990, abandoned, which is a continuation of Ser. No. 9,162, Jan. 30, 1987, abandoned.

[51] Int. Cl.[6] ..... C10M 137/04

[52] U.S. Cl. ..... 252/18; 252/45; 252/49.8

[58] Field of Search ..... 252/18, 45, 49.8

[56] References Cited

U.S. PATENT DOCUMENTS

| | | | |
|---|---|---|---|
| 2,963,451 | 12/1960 | Coates | 260/2 |
| 3,036,109 | 5/1962 | Walsh | 260/461 |
| 3,082,187 | 3/1963 | Fuchsman et al. | 260/45.95 |
| 3,115,464 | 12/1963 | Orloff et al. | 252/49.8 |
| 3,321,401 | 5/1967 | Ford et al. | 252/46.7 |
| 3,376,232 | 4/1968 | Coover et al. | 252/400 |
| 3,446,739 | 5/1969 | Papay | 252/49.8 |
| 3,471,403 | 10/1969 | LeSuer et al. | 252/39 |
| 3,488,284 | 1/1970 | LeSuer et al. | 252/33 |
| 3,583,915 | 6/1971 | Myers | 252/46.6 |
| 3,595,790 | 7/1971 | Norman et al. | 252/32.7 |
| 3,652,410 | 3/1972 | Hollinghurst et al. | 252/32.7 E |
| 3,763,287 | 10/1973 | Chiddix et al. | 260/941 |
| 3,929,650 | 12/1975 | King et al. | 252/33.4 |
| 3,932,290 | 1/1976 | Koch et al. | 252/49.8 |
| 3,951,830 | 4/1976 | Karn | 252/42.7 |
| 4,077,892 | 3/1978 | Frangatos | 252/49.9 |
| 4,119,549 | 10/1978 | Davis | 252/45 |
| 4,191,659 | 4/1980 | Davis | 252/45 |
| 4,417,990 | 11/1983 | Clason et al. | 252/32.7 E |
| 4,579,672 | 1/1986 | Brecker et al. | 252/49.8 |
| 4,589,993 | 5/1986 | Cleveland et al. | 252/78.5 |
| 4,659,488 | 4/1987 | Vinci | 252/33 |

FOREIGN PATENT DOCUMENTS

| | | |
|---|---|---|
| 0075411 | 3/1983 | European Pat. Off. . |
| 0237804 | 9/1987 | European Pat. Off. . |
| 1121713 | 7/1968 | United Kingdom . |
| 87/01723 | 3/1987 | WIPO . |
| 87/05927 | 10/1987 | WIPO . |
| 88/04684 | 6/1988 | WIPO . |

OTHER PUBLICATIONS

Additives for Gear Oils– Function and Interaction, Damrath, J. G. Jr. and Papay, A. G., (date n/a) Addit, Schmierst. Arbeitsfluessigkeiten Int. Kolloq., 5th, pp. 4.2–1 to 4.2–8. (No Date).

*Primary Examiner*—Ellen M. McAvoy
*Attorney, Agent, or Firm*—Joseph P. Fishcer; Frederick D. Hunter; James L. Cordek

[57] ABSTRACT

Gear oil compositions are described which comprise a lubricating base oil having dissolved therein:

(A) at least one phosphite ester characterized by the formula:

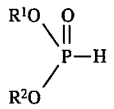

wherein $R^1$ and $R^2$ are hydrocarbyl based groups of from 1 to 30 carbon atoms and (B) at least one metal overbased composition.

Another embodiment of the invention comprises the above-mentioned (A) and (B) with (C) a sulfurization product of an aliphatic olefinic compound containing from 3 to 30 carbon atoms.

11 Claims, No Drawings

GEAR LUBRICANT COMPOSITION

This is a continuation of application Ser. No. 07/579,182, filed Sep. 5, 1990, now abandoned, which in turn is a continuation of Ser. No. 07/009,162, filed Jan. 30, 1987, now abandoned.

BACKGROUND OF THE INVENTION

1. Field of the Invention

This invention concerns lubricating oil compositions which are especially adapted for use in mechanical systems where gears are subjected to great stress and extremely high pressures such as those found in automotive rear axles or off highway transmissions and gear boxes. More particularly, the present invention relates to lubricants and functional fluids which are useful particularly in environments characterized by high pressure and rubbing surfaces.

2. Description of the Related Art

U.S. Pat. No. 3,082,187 (Fuchsmanf, et al, Mar. 19, 1963) broadly stated comprises a polyalkene having intimately dispersed therein (a) from about 0.005% to about 10% by weight of an organic phosphite ester having the general formula:

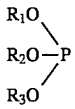

wherein $R_1$, $R_2$ and $R_3$ are each selected from the group consisting of hydrogen and hydrocarbon radicals containing from 1 to 21 carbon atoms, at least two of $R_1$, $R_2$ and $R_3$ being a hydrocarbon radical; and (b) from about 0.005% to about 10% by weight of a sulfurized phenol having the general formula:

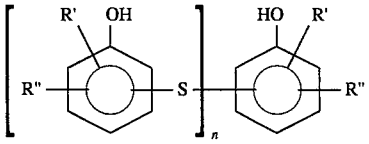

wherein n is from 1 to 10, and R' and R" are each selected from the group consisting of hydrogen and alkyl radicals containing from 1 to 18 carbon atoms, at least one of R' and R" being alkyl.

U.S. Pat. No. 3,583,915 (Myers, Jun. 8, 1971) deals with the combination of a di(organo)hydrogen phosphonate, in which at least one organo group is an aliphatic group containing at least 14 carbon atoms, in admixture with an active sulfur compound evidences synergistic load carrying properties in organic base media.

The di(organo)phosphonates have the structure

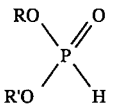

wherein R and R' are individually alkyl or alkenyl from 1 to 30 carbon atoms and at least one of which is an aliphatic group of at least 14 carbon atoms, and preferably over 16 carbon atoms. These groups may have the same number of carbon atoms or different, and one may be further substituted by the presence of alkoxy, hydroxy and halogen substituents. Dioctadecyl and dioleyl phosphonates are of particular interest. The phosphonates used may be produced by known methods of synthesis.

The second co-additive may be designated as an active sulfur compound. The compounds of this class include organic sulfides and sulfurized hydrocarbons having up to 65% sulfur. Encompassed in this class are those compounds wherein the sulfur is "loosely-bound," and the non-corrosive or "firmly-bound" sulfur compounds. More specifically, such compounds include sulfurized animal and vegetable oils and fats and mineral oils containing at least 1% and up to 20% sulfur; up to about 10% for "firmly-bound" and from about 10% to 20% or more for "loosely-bound"

U.S. Pat. No. 3,446,739 (Papayannopoulos, May 27, 1969) provides organic compositions which contain additives effective for imparting limited-slip properties thereto, but which do not detract from the extreme pressure properties of such compositions.

These organic compositions comprise an alkyl phosphite and an ester of a fatty acid and a fatty alcohol, wherein alkyl groups of the phosphite and alkyl groups of the fatty acid and the fatty alcohol each contain from about 12 to about 30 carbon atoms. In general, in its preferred applications, this patent contemplates organic compositions exhibiting effective extreme pressure properties under varying operating conditions, and which also contain a small amount of the above-described additive limited-slip improver mixture, usually from about 0.1% to about 40% by weight, and preferably from about 0.5% to about 10% by weight of the total weight of such composition. Insofar as the additive mixture itself is concerned, the alkyl phosphite is present in an amount from about 10% to about 90% by weight, and, correspondingly, the ester is present in an amount from about 90% to about 10% by weight of the total weight of said mixture.

U.S. Pat. No. 3,321,401 (Ford, et al, May 23, 1967) provides for lubricating compositions containing a combination of additives that has the effect of improving the load-carrying properties of the compositions.

According to the patent, there is provided a lubricating compositions comprising a lubricating base oil having dissolved therein small proportions each of (a) an organic phosphite of the formula:

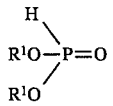

where the $R^1$s are alkyl, cycloalkyl, aryl or aralkyl groups and the total number of carbon atoms in the molecule is 1 to 20 and (b) another oil-soluble organic phosphorus compound of the general formula:

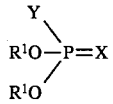

where X is an oxygen or sulfur atom and Y is $R^1O$ - - - or

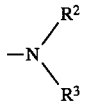

where $R^1$ has the value previously given, $R^2$ and $R^3$ hydrogen or alkyl, cycloalkyl, aryl or aralkyl groups or together with the nitrogen atom form a ring which, apart from the nitrogen, is made up of hydrocarbon groups or hydrocarbon groups and a second hetero atom, e.g. oxygen, and the total number of carbon atoms in the molecule is 1 to 30.

SUMMARY OF THE INVENTION

Gear oil compositions are described which comprise a lubricating base oil having dissolved therein:

(A) at least one phosphite ester characterized by the formula:

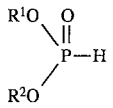

wherein $R^1$ and $R^2$ are hydrocarbyl based groups of from 1 to 30 carbon atoms and (B) at least one metal overbased composition.

Another embodiment of the invention comprises the above-mentioned (A) and (B) with (C) a sulfurization product of an aliphatic olefinic compound containing from 3 to 30 carbon atoms.

DETAILED DESCRIPTION OF THE INVENTION (A) The Phosphite Ester

The phosphite esters which are included in the compositions of the present invention are characterized by the formula:

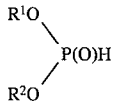

(I)

wherein $R^1$ and $R^2$ are hydrocarbyl based groups. The hydrocarbyl groups $R^1$and $R^2$ each contain from 1 to about 30 carbon atoms; preferably from 4 to 12 carbon atoms and most preferably from 8 to 10 carbon atoms.

As used in this specification and appended claims, the terms "hydrocarbyl" or hydrocarbon-based" denote a group having a carbon atom directly attached to the remainder of the molecule and having predominantly hydrocarbon character within the context of this invention. Such groups include the following:

(1) Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, phenyl, etc.

(2) Substituted hydrocarbon groups; that is, groups containing non-hydrocarbon substituents which, in the context of this invention, do not alter the predominantly hydrocarbon character of the group. Those skilled in the art will be aware of suitable substituents. Examples include halo, hydroxy, nitro, cyano, alkoxy, acyl, etc.

(3) Hetero groups; that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

Terms such as "alkyl-based group" "aryl-based group" and the like have meaning analogous to the above with respect to alkyl and aryl groups and the like.

The $R^1$ group may comprise a mixture of hydrocarbyl groups derived from commercial alcohols. Examples of some preferred monohydric alcohols and alcohol mixtures include the commercially available "Alfol" alcohols marketed by Continental Oil Corporation. Alfol 810 is a mixture containing alcohols consisting essentially of straight-chain, primary alcohols having from 8 to 10 carbon atoms. Alfol 12 is a mixture comprising mostly $C_{12}$ fatty alcohols. Alfol 1218 is a mixture of synthetic, primary, straight-chain alcohols having 12 to 18 carbon atoms. The Alfol 20+ alcohols are mostly, on an alcohol basis, $C_{20}$ alcohols as determined by GLC (gas-liquid-chromatography). The Alfol 22+ alcohols are $C_{18-28}$ primary alcohols having mostly, on an alcohol basis, $C_{22}$ alcohols. These Alfol alcohols can contain a fairly large percentage (up to 40% by weight) of paraffinic compounds which can be removed before the reaction if desired.

Another example of a commercially available alcohol mixture is Adol 60 which comprises about 75% by weight of a straight-chain $C_{22}$ primary alcohol, about 15% of a $C_{20}$ primary alcohol and about 8 % of $C_{18}$ and $C_{24}$ alcohols. Adol 320 comprises predominantly oleyl alcohol. The Adol alcohols are marketed by Ashland Chemical.

A variety of mixtures of monohydric fatty alcohols derived from naturally occurring triglycerides and ranging in chain length of from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{15}$ alcohols; Neodol 25 is a mixture of $C_{12}$ and $C_{13}$ alcohols, Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$ $C_{10}$ and $C_{11}$ alcohols.

The dihydrocarbyl phosphites (A) useful in the present invention may be prepared by techniques well known in the art, and many dihydrocarbyl phosphites are available commercially. In one method of preparation, a lower molecular weight dialkylphosphite (e.g., dimethyl) is reacted with alcohols comprising a straight-chain alcohol, a branched-chain alcohol or mixtures thereof. As noted above, each of the two types of alcohols may themselves comprise mixtures. Thus, the straight-chain alcohol may comprise a mixture of straight-chain alcohols and the branched-chain alcohols may comprise a mixture of branched-chain alcohols. The higher molecular weight alcohols replace the methyl groups (analogous to classic transesterification) with the formation of methanol which is stripped from the reaction mixture.

In another embodiment, the branched chain hydrocarbyl group can be introduced into a dialkylphosphite by reacting the low molecular weight dialkylphosphite such as dimethylphosphite with a more sterically hindered branched-chain alcohol such as neopentyl alcohol (2,2-dimethyl-1-propanol). In this reaction, one of the methyl groups is replaced by a neopentyl group, and, apparently because of the size of the neopentyl group, the second methyl group is not displaced by the neopentyl alcohol. Another neo alcohol having utility in this invention is 2,2,4-trimethyl-1-pentanol.

The following examples illustrate the preparation of the phosphite esters (A) which are useful in the compositions of the present invention. Unless otherwise indicated in the following examples and elsewhere in the specification and claims, all parts and percentages are by weight, and all temperatures are in degrees centigrade.

EXAMPLE A-1

A mixture of 911.4 parts (7 moles) of 2-ethylhexanol, 1022 parts (7 moles) of Alfol 8-10, ad 777.7 parts (7 moles) of dimethylphosphite is prepared and heated to 125° C. while sparging with nitrogen and removing methanol as a distillate. After about 6 hours, the mixture was heated to 145° C. and maintained at this temperature for an additional 6 hours whereupon about 406 parts of distillate are recovered. The reaction mixture is stripped to 150° C. at 50 mm. Hg., and an additional 40 parts of distillate are recovered. The residue is filtered through a filter aid and the filtrate is the desired mixed dialkyl hydrogen phosphite containing 9.6% phosphorus (theory, 9.7%).

EXAMPLE A-2

A mixture of 468.7 parts (3.6 moles) of 2-ethylhexanol, 1050.8 parts (7.20 moles) of Alfol 8–10, and 600 parts (5.4 moles) of dimethylphosphite is prepared and heated to 135° C. while purging with nitrogen. The mixture is heated slowly to 145° C. and maintained at this temperature for about 6 hours whereupon a total of 183.4 parts of distillate are recovered. The residue is vacuum stripped to 145° C. (10 mm. Hg.) and 146.3 parts of additional distillate are recovered. The residue is filtered through a filter aid, and the filtrate is the desired product containing 9.3% phosphorus (theory, 9.45%).

EXAMPLE A-3

A mixture of 518 parts (7 moles) of n-butanol, 911.4 parts (7 moles) of 2-ethylhexanol, and 777.7 parts (7 moles) of dimethylphosphite is prepared and heated to 120° C. while blowing with nitrogen. After about 7 hours, 322.4 parts of distillate are collected, and the material then is vacuum stripped (50 mm. Hg. at 140° C.) whereupon an additional 198.1 parts of distillate are recovered. The residue is filtered through a filter aid, and the filtrate is the desired product containing 12.9% phosphorus (theory, 12.3%).

EXAMPLE A-4

A mixture of 193 parts (2.2 moles) of 2,2-dimethyl-1-propanol and 242 parts (2.2 moles) of dimethylphosphite is prepared and heated to about 120° C. while blowing with nitrogen. A distillate is removed and collected, and the residue is vacuum stripped. The residue is filtered and the filtrate is the desired product containing 14.2% phosphorus.

(B) The Metal Overbased Composition

The compositions of the present invention also comprise mixtures of the above-described phosphite esters (A) with (B) at least one metal overbased salt of an organic acid. The weight ratio of (A:B) may range from 100:1 to 1:100; preferably 50:1 to 1:50, more preferably 25:1 to 1:25 and most preferably 10:1 to 1:10.

These overbased salts of organic acids are widely known to those of skill in the art and generally include metal salts wherein the amount of metal present in them exceeds the stoichiometric amount. Such salts are said to have conversion levels in excess of 100% (i.e., they comprise more than 100% of the theoretical amount of metal needed to convert the acid to its "normal" "neutral" salt). Such salts are often said to have metal ratios in excess of one (i.e., the ratio of equivalents of metal to equivalents of organic acid present in the salt is greater than that required to provide the normal or neutral salt which required only a stoichiometric ratio of 1:1). They are commonly referred to as overbased, hyperbased or superbased salts and are usually salts of organic sulfur acids, organic phosphorus acids, carboxylic acids, phenols or mixtures of two or more of any of these. As a skilled worker would realize, mixtures of such overbased salts can also be used.

The terminology "metal ratio" is used in the prior art and herein to designate the ratio of the total chemical equivalents of the metal in the overbased salt to the chemical equivalents of the metal in the salt which would be expected to result in the reaction between the organic acid to be overbased and the basically reacting metal compound according to the known chemical reactivity and stoichiometry of the two reactants. Thus, in a normal or neutral salt the metal ratio is one and in an overbased salt the metal ratio is greater than one.

The overbased salts used as (B) in this invention usually have metal ratios of at least about 3:1. Typically, they have ratios of at least about 12:1. Usually they have metal ratios not exceeding about 40:1. Typically salts having ratios of about 12:1 to about 20:1 are used.

The basically reacting metal compounds used to make these overbased salts are usually an alkali or alkaline earth metal compound (i.e., the Group IA, IIA, and IIB metals excluding francium and radium and typically excluding rubidium, cesium and beryllium) although other basically reacting metal compounds can be used. Compounds of Ca, Ba, Mg, Na and Li, such as their hydroxides and alkoxides of lower alkanols are usually used as basic metal compounds in preparing these overbased salts but others can be used as shown by the prior art incorporated by reference herein. Overbased salts containing a mixture of ions of two or more of these metals can be used in the present invention.

These overbased salts can be of oil-soluble organic sulfur acids such as sulfonic, sulfamic, thiosulfonic, sulfinic, sulfenic, partial ester sulfuric, sulfurous and thiosulfuric acid. Generally they are salts of carbocylic or aliphatic sulfonic acids.

The carbocylic sulfonic acids include the mono- or polynuclear aromatic or cycloaliphatic compounds. The oil-soluble sulfonates can be represented for the most part by the following formulae:

$$[R_x—T—(SO_3)_y]_zM_b \quad \text{(II)}$$

$$[R^3—(SO_3)_a]_dM_b \quad \text{(III)}$$

In the above formulae, M is either a metal cation as described hereinabove or hydrogen; T is a cyclic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohexane, petroleum naphthenes, decahydro-naphthalene, cyclopentane, etc.: R in Formula II is an aliphatic group such as alkyl, alkenyl, alkoxy, alkoxyalkyl, carboalkoxyalkyl, etc; x is at least 1, and $R_x$+T contains a total of at least about 15 carbon atoms, $R^3$ in Formula III is an aliphatic radical containing at least about 15 carbon atoms and M is either a metal cation or hydrogen. Examples of type of the $R^3$ radical are alkyl, alkenyl, alkoxyalkyl, carboalkoxyalkyl, etc. Specific examples of $R^3$ are groups derived from petrolatum, saturated and unsaturated paraffin wax, and polyolefins, including polymerized $C_2$, $C_3$, $C_4$, $C_5$, $C_6$, etc., olefins containing from about 15 to 7000 or more carbon atoms. The groups T, R, and $R^3$ in the above formulae can also contain other inorganic or organic substituents in addition to those enumerated above such as, for example, hydroxy, mercapto, halogen, nitro, amino, nitroso, sulfide, disulfide, etc. In Formula II, x, y, z and b are at least 1, and likewise in Formula III, a, b and d are at least 1.

Specific examples of sulfonic acids useful in this invention are mahogany sulfonic acids; bright stock sulfonic acids; sulfonic acids derived from lubricating oil fractions having a Saybolt viscosity from about 100 seconds at 100° F. to about 200 seconds are 210° F.; petrolatum sulfonic acids; mono- and poly-wax substituted sulfonic and polysulfonic acids of, e.g., benzene, naphthalene, phenol, diphenyl ether, napthalene disulfide, diphenylamine, thiophene, alpha-chloronaphthalene, etc.; other substituted sulfonic acids such as alkyl benezne sulfonic acids (where the alkyl group has at least 8 carbons), cetylphenol mono-sulfide sulfonic acids, dicetyl thianthrene disulfonic acids, dilauryl beta naphthyl sulfonic acid, dicapryl nitronaphthalene sulfonic acids, and alkaryl sulfonic acids such as dodecyl benzene "bottoms" sulfonic acids.

The latter acids derived from benzene which has been alkylated with propylene tetramers or isobutene trimers to introduce 1,2,3, or more branched-chain $C_{12}$ substituents on the benzene ring. Dodecyl benzene bottoms, principally mixtures of mono-and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture-by-products by reaction with, e.g., $SO_3$, is well known to those skilled in the art. See, for example, the article "Sulfonates" in Kirk-Othmer "Encyclopedia of Chemical Technology" Second Edition, Vol. 19, pp 291 at seq. published by John Wiley & Sons, N.Y. (1969).

Other descriptions of overbased sulfonate salts and techniques for making them can be found in the following U.S. Pat. Nos. 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,297; 2,315,514; 2,319,121; 2,321,022; 2,333,568; 2,333,788; 2,335,259; 2,337,552; 2,346,568; 2,366,027; 2,374,193; 2,383,319; 3,312,618; 3,471,403; 3,488,284; 3,595,790; and 3,798,012. These are hereby incorporated by reference for their disclosures in this regard.

Also included are aliphatic sulfonic acids such as paraffin wax sulfonic acids, unsaturated paraffin wax sulfonic acids, hydroxy-substituted paraffin wax sulfonic acids, hexapropylene sulfonic acids, tetra-amylene sulfonic acids, polyisobutene sulfonic acids wherein the polyisobutene contains from 20 to 7000 or more carbon atoms, chloro-substituted paraffin wax sulfonic acids, nitroparaffin wax sulfonic acids, etc.; cycloaliphatic sulfonic acids such as petroleum naphthene sulfonic acids, cetyl cyclopentyl sulfonic acids, lauryl cyclohexyl sulfonic acids, bis-(di-isobutyl) cyclohexyl sulfonic acids, etc.

With respect to the sulfonic acids or salts thereof described herein and in the appended claims, it is intended that the term "petroleum sulfonic acids" or "petroleum sulfonates" includes all sulfonic acids or the salts thereof derived from petroleum products. A particularly valuable group of petroleum sulfonic acids are the mahogany sulfonic acids (so called because of their reddish-brown color) obtained as a by-product from the manufacture of petroleum white oils by a sulfuric acid process.

Generally Group IA, IIA and IIB overbased salts of the above-described synthetic and petroleum sulfonic acids are typically useful in making (B) of this invention.

Component B may also be a borated complex of an alkali overbased metal salt such as described hereinabove. Borated complexes of this type may be prepared by heating the basic alkali metal salt with boric acid at about 50°–100° C., the number of equivalents of boric acid being roughly equal to the number of equivalents of alkali metal in the salt. U.S. Pat. No. 3,929,650 is incorporated by reference herein for its disclosure of borated complexes.

The carboxylic acids from which suitable overbased salts for use in this invention can be made include aliphatic, cycloaliphatic, and aromatic mono- and polybasic carboxylic acids such as the napthenic acids, alkyl- or alkenyl-substituted cyclopentanoic acids, alkyl- or alkenyl-substituted cyclohexanoic acids, alkyl- or alkenyl-substituted aromatic carboxylic acids. The aliphatic acids generally contain at least 8 carbon atoms and preferably at least 12 carbon atoms. Usually they have no more than about 400 carbon atoms. Generally, if the aliphatic carbon chain is branched, the acids are more oil-soluble for any given carbon atoms content. The cycloaliphatic and aliphatic carboxylic acids can be saturated or unsaturated. Specific examples include 2-ethylhexanoic acid, a-linolenic acid, propylene-tetramer-substituted maleic acid, behenic acid, isostearic acid, pelargonic acid, capric acid, palmitoleic acid, linoleic acid, lauric acid, oleic acid, ricinoleic acid, undecylic acid, dioctylcyclopentane carboxylic acid, myristic acid, dilauryldecahydronaphthalene carboxylic acid, stearyloctahydroindene carboxylic acid, palmitic acid, commercially available mixtures of two or more carboxylic acids such as tall oil acids, rosin acids, and the like.

A typical group of oil-soluble carboxylic acids useful in preparing the salts used in the present invention are the oil-soluble aromatic carboxylic acids. These acids are represented by the general formula:

$$(R^*)_a-(Ar^*)-\left[\begin{matrix} X \\ \| \\ C-XH \end{matrix}\right]_m \qquad \text{(IV)}$$

wherein R* is an aliphatic hydrocarbon-based group of at least 4 carbon atoms, and no more than about 400 aliphatic carbon atoms, a is an integer from one to four, Ar* is a polyvalent aromatic hydrocarbon nucleus of up to about 14 carbon atoms, each X is independently a sulfur or oxygen atom, and m is an integer of from one to four with the proviso that R* and a are such that there is an average of at least 8 aliphatic carbon atoms provided by the R* groups for each acid molecule represented by Formula IV. Examples of aromatic nuclei represented by the variable Ar* are the polyvalent aromatic radicals derived from benzene, napthalene anthracene, phenanthrene, indene, fluorene, biphenyl, and the like. Generally, the radical represented by Ar* will be a polyvalent nucleus derived from benzene or naphthalene such as phenylenes and naphthylene, e.g., methyphenylenes, ethoxyphenylenes, nitrophenylenes, isopropylenes, hydroxyphenylenes, mercaptophenylenes, N,N-diethylaminophenylenes, chlorophenylenes, N,N-diethylaminophenylenes, chlorophenylenes, dipropoxynaphthylenes, triethylnaphthylenes, and similar tri-, tetra-, pentavalent nuclei thereof, etc.

The R* groups are usually hydrocarbyl groups, preferably groups such as alkyl or alkenyl radicals. However, the R* groups can contain small number substituents such as phenyl, cycloalkyl (e.g., cyclohexyl, cyclopentyl, etc.) and nonhydrocarbon groups such as nitro, amino, halo (e.g., chloro, bromo, etc.), lower alkoxy, lower alkyl mercapto, oxo substituents (i.e., =O), thio groups (i.e., =S), interrupting groups such as —NH—, —O—, —S—, and the like provided the essentially hydrocarbon character of the R* group is retained. The hydrocarbon character is retained for purposes of this invention so long as any non-carbon atoms present in the R* groups do not account for more than about 10% of the total weight of the R* groups.

Examples of R* groups include butyl, isobutyl, pentyl, octyl, nonyl, dodecyl, docosyl, tetracontyl, 5-chlorohexyl, 4-ethoxypentyl, 4-hexenyl, 3-cyclohexyloctyl, 4-(p-chlorophenyl)-octyl, 2,3,5-trimethylheptyl, 4-ethyl-5-methyloctyl, and substituents derived from polymerized olefins such as polychloroprenes, polyethylenes, polypropylenes, polyisobutylenes, ethylene-propylene copolymers, chlorinated olefin polymers, oxidized ethylene-propylene copolymers, and the like. Likewise, the group Ar* may contain nonhydrocarbon substituents, for example, such diverse substituents as lower alkoxy, lower alkyl mercapto, nitro, halo, alkyl or alkenyl groups of less than 4 carbon atoms, hydroxy, mercapto, and the like.

Another group of useful carboxylic acids are those of the formula:

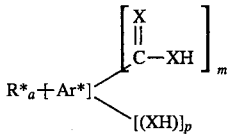

(V)

wherein R*, X, Ar*, m and a are as defined in Formula IV and p is an integer of 1 to 4, usually 1 or 2. Within this group, an especially preferred class of oil-soluble carboxylic acids are those of the formula:

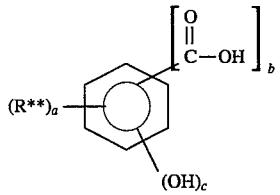

(VI)

wherein R in Formula VI is an aliphatic hydrocarbon group containing at least 4 to about 400 carbon atoms, a is an integer of from 1 to 3, b is 1 or 2, c is zero, 1, or 2 and preferably 1 with the proviso that R and a are such that the acid molecules contain at least an average of about 12 aliphatic carbon atoms in the aliphatic hydrocarbon substituents per acid molecule. And within this latter group of oil-soluble carboxylic acids, the aliphatic-hydrocarbon substituted salicyclic acids wherein each aliphatic hydrocarbon substituent contains an average of at least about 16 carbon atoms per substituent and 1 to 3 substituents per molecule are particularly useful. Salts prepared from such salicyclic acids wherein the aliphatic hydrocarbon substituents are derived from polymerized olefins, particularly polymerized lower 1-mono-olefins such as polyethylene, polypropylene, polyisobutylene, ethylene/-propylene copolymers and the like and having average carbon contents of about 30 to about 400 carbon atoms.

The carboxylic acids corresponding to Formulae IV-V above are well known or can be prepared according to procedures known in the art. Carboxylic acids of the type illustrated by the above formulae and processes for preparing their overbased metal salts are well known and disclosed, for example, in such U.S. Pat. Nos. as 2,197,832; 2,197,835; 2,252,662; 2,252,664; 2,714,092; 3,410,798 and 3,595,791 which are incorporated by reference herein for their disclosures of acids and methods of preparing overbased salts.

Another type of overbased carboxylate salt used in making (B) of this invention are those derived from alkenyl succinates of the general formula:

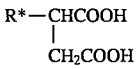

(VII)

wherein R* is as defined above in Formula IV. Such salts and means for making them are set forth in U.S. Pat. Nos. 3,271,130, 3,567,637 and 3,632,510, which are hereby incorporated by reference in this regard.

Other patents specifically describing techniques for making overbased salts of the hereinabove-described sulfonic acids, carboxylic acids, and mixtures of any two or more of these include U.S. Pat. Nos. 2,501,731; 2,616,904; 2,616,905; 2,616,906; 2,616,911; 2,616,924; 2,616,925; 2,617,049; 2,777,874; 3,027,325; 3,256,186; 3,282,835; 3,384,585; 3,373,108; 3,365,296; 3,342,733; 3,320,162; 3,312,618; 3,318,809; 3,471,403; 3,488,284; 3,595,790; and 3,629,109. The disclosures of these patents are hereby incorporated in this present specification for their disclosures in this regard as well as for their disclosure of specific suitable basic metal salts.

In the context of this invention, phenols are considered organic acids. Thus, overbased salts of phenols (generally known as phenates) are also useful in making (B) of this invention are well known to those skilled in the art. The phenols from which these phenates are formed are of the general formula:

(VIII)

wherein R*, n, Ar*, X and m have the same meaning and preferences are described hereinabove with reference to Formula IV. The same examples described with respect to Formula IV also apply.

A commonly available class of phenates are those made from phenols of the general formula:

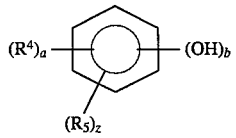

(IX)

wherein a is an integer of 1–3, b is of 1 or 2, z is 0 or 1 $R^4$ in Formula IX is a hydrocarbyl-based substituent having an average of from 4 to about 400 aliphatic carbon atoms and $R^5$ is selected from the group consisting of lower hydrocarbyl, lower alkoxyl, nitro, amino, cyano and halo groups.

One particular class of phenates for use in this invention are the overbased, Group IIA metal sulfurized phenates made by sulfurizing a phenol as described hereinabove with a sulfurizing agent such as sulfur, a sulfur halide, or sulfide or hydrosulfide salt. Techniques for making these sulfurized phenates are described in U.S. Pat. Nos. 2,680,096; 3,036,971; and 3,775,321 which are hereby incorporated by reference for their disclosures in this regard.

Other phenates that are useful are those that are made from phenols that have been linked through alkylene (e.g., methylene) bridges. These are made by reacting single or multi-ring phenols with aldehydes or ketones, typically, in the presence of an acid or basic catalyst. Such linked phenates as well as sulfurized phenates are described in detail in U.S. Pat. No. 3,350,038; particularly columns 6–8 thereof, which is hereby incorporated by reference for its disclosures in this regard.

Generally Group IIA overbased salts of the above-described carboxylic acids are typically useful in making (B) of this invention.

The method of preparing metal overbased compositions in this manner is illustrated by the following examples.

EXAMPLE B-1

A mixture consisting essentially of 480 parts of a sodium petrosulfonate (average molecular weight of about 480), 84 parts of water, and 520 parts of mineral oil is heated at 100° C. The mixture is then heated with 86 parts of a 76% aqueous solution of calcium chloride and 72 parts of lime (90% purity) at 100° C. for two hours, dehydrated by heating to a water content of less than about 0.5%, cooled to 50° C., mixed with 130 parts of methyl alcohol, and then blown with carbon dioxide at 50° C. until substantially neutral. The mixture is then heated to 150° C. to distill off methyl alcohol and water and the resulting oil solution of the basic calcium sulfonate filtered. The filtrate is found to have a calcium sulfate ash content of 16% and a metal ratio of 2.5. A mixture of 1305 parts of the above carbonated calcium petrosulfonate, 930 parts of mineral oil, 220 parts of methyl alcohol, 72 parts of isobutyl alcohol, and 38 parts of amyl alcohol is prepared, heated to 35° C., and subjected to the following operating cycle four times: mixing with 143 parts of 90% commercial calcium hydroxide (90% calcium hydroxide) and treating the mixture with carbon dioxide until it has a base number of 32–39. The resulting product is then heated to 155° C. during a period of nine hours to remove the alcohol and filtered at this temperature. The filtrate is characterized by a calcium sulfate ash content of about 40% and a metal ratio of about 12.2.

EXAMPLE B-2

A mineral oil solution of a basic, carbonated calcium complex is prepared by carbonating a mixture of an alkylated benzene sulfonic acid (molecular weight of 470) an alkylated calcium phenate, a mixture of lower alcohols (methanol, butanol, and pentanol) and excess lime (5.6 equivalents per equivalent of the acid). The solution has a sulfur content of 1.7%, a calcium content of 12.6% and a base number of 336. To 950 grams of the solution, there is added 50 grams of a polyisobutene (molecular weight of 1000)-substituted succinic anhydride (having a saponification number of 100) at 25° C. The mixture is stirred, heated to 150° C., held at that temperature for 0.5 hour, and filtered. The filtrate has a base number of 315 and contains 35.4% of mineral oil.

EXAMPLE B-3

To 950 grams of a solution of a basic, carbonated, calcium salt of an alkylated benzene sulfonic acid (average molecular weight –425) in mineral oil (base number –406, calcium –15.2% and sulfur –1.4%) there is added 50 grams of the polyisobutenyl succinic anhydride of Example B-2 at 57° C. The mixture is stirred for 0.65 hour at 55°–57° C., then at 152°–153° C. for 0.5 hour and filtered at 105° C. The filtrate has a base number of 387 and contains 43.7% of mineral oil.

EXAMPLE B-4

A mixture comprising 753 parts (by weight) of mineral oil, 1440 parts of xylene, 84 parts of a mixture of a commercial fatty acid mixture (acid number of 200, 590 parts of an alkylated benzene sulfonic acid (average molecular weight –500), and 263 parts of magnesium oxide is heated to 60° C. Methanol (360 parts) and water (180 parts) are added. The mixture is carbonated at 65° C.–98° C. while methanol and water are being removed by azeotropic distillation. Additional water (180 parts) is then added and carbonation is continued at 87°–90° C. for three and a half hours. Thereafter, the reaction mixture is heated to 160° C. at 20 torr and filtered at 160° C. to give a basic, carbonated magnesium sulfonate-carboxylate complex (78.1% yield) containing 7.69% of magnesium and 1.67% of sulfur and having a base number of 336. To 950 parts of the above basic, carbonated magnesium complex, there is added 50 parts of the polyisobutenyl complex, there is added 50 parts of the polyisobutenyl succinic anhydride of Example B-2 and the mixture is heated to 150° C. for one-half hour and then filtered to give a composition having a base number of 315.

EXAMPLE B-5

A mixture comprising 906 grams (1.5 equivalents) of an oil solution of an alkylbenzene sulfonic acid (average molecular weight –460–480), 564 grams of mineral oil, 600 grams of toluene, 95.7 grams of magnesium oxide (4.4 equivalents), and 120 grams of water is carbonated at a temperature of about 78°–85° C. for about 7 hours at a rate of about 3 cubic feet of carbon dioxide per hour. The carbonated product is stripped by heating to 165° C. at a pressure of 20 torr and filtered. The filtrate is an oil solution of a basic, carbonated magnesium sulfonate complex having a metal ratio of 3.1 and containing 15.27% of magnesium sulfate ash, 2.66% of sulfur and a base number of 98. To 95 grams of this complex there is added 5 grams of the polyisobutenyl succinic anhydride of Example B-2 and the mixture is stirred at 150° C. and filtered.

EXAMPLE B-6

A mixture of 2,576 grams of mineral oil, 240 grams (1.85 equivalents) of octyl alcohol, 740 grams (20.0 equivalents) of calcium hydroxide, 2304 grams (8 equivalents) of oleic acid, and 392 grams (12.3 equivalents) of methyl alcohol is heated with stirring to a temperature about 50° C. in about 0.5 hour. This mixture then is treated with $CO_2$ (3 cubic feet per hour) at 50°–60° C. for a period of about 3.5 hours. The resulting mixture is heated to 150° C. and filtered. The filtrate is a basic calcium oleate complex having the following analyses:

Sulfate ash (%) 24.1

Metal ratio 2.5

Neutralization No. (acidic) 2.0

EXAMPLE B-7

A reaction mixture comprising 1044 grams (about 1.5 equivalents) of an oil solution of an alkylphenyl sulfonic acid (average molecular weight –500), 1200 grams of mineral 981, 2400 grams of xylene, 138 grams (about 0.5 equivalents) of tall oil acid mixture (oil-soluble fatty acid mixture sold by Hercules under the name PAMAK-4), 434 grams (20 equivalents) of magnesium oxide, 600 grams of methanol, and 300 grams of water is carbonated at a rate of 6 cubic feet of carbon dioxide per hour at 65°–70° C. (methanol reflux). The carbon dioxide introduction rate was decreased as the carbon dioxide uptake diminished. After 2.5 hours of carbonation, the methanol is removed and by raising the temperature of the mixture to about 95° C. with continued carbon dioxide blowing at a rate of about two cubic feet per hour for one hour. Then 300 grams of water is added to the reaction mixture and carbonation was continued at about 90° C. (reflux) for about four hours. The material becomes hazy with the addition of the water but clarifies after 2–3 hours of continued carbonation. The carbonated product is then stripped to 160° C. at 20 torr and filtered. The filtrate is a concentrated oil solution (47.5% oil) of the desired basic magnesium salt, the salt being characterized by a metal ratio of about 10.

EXAMPLE B-8

Following the general procedure of Example B-7 but adjusting the weight ratio of methanol to water in the initial reaction mixture to 4:3 in lieu of the 2:1 ratio of Example B-7 another concentrated oil-solution (57.5% oil) of a basic magnesium salt is produced. This methanol-water ratio gives improved carbonation at the methanol reflux stage of carbonation and prevents thickening of the mixture during the 90° C. carbonation stage.

EXAMPLE B-9

A reaction mixture comprising 135 parts mineral oil, 330 parts xylene, 200 parts (0,235 equivalent) of a mineral oil solution of an alkylphenylsulfonic acid (average molecular weight –425), 19 parts (0.068 equivalent) of the above-described mixture of tall oil acids, 60 parts (about 2.75 equivalents) of magnesium oxide, 83 parts methanol, and 62 parts water are carbonated at a rate of 15 parts of carbon dioxide per hour for about 2 hours at the methanol reflux temperature. The carbon dioxide inlet rate is then reduced to about 7 parts per hour and the methanol is removed by raising the temperature to about 98° C. over a 3 hour period. Then 47 parts of water are added and carbonation is continued for an additional 35. hours at a temperature of about 95° C. The carbonated mixture is then stripped by heating to a temperature of 140°–145° C. over a 2.5 hour period. This results in an oil solution of a basic magnesium salt characterized by a metal ratio of about 10.

Then, the carbonated mixture is cooled to about 60°–65° C. and 208 parts xylene, 60 parts magnesium oxide, 83 parts methanol and 62 parts water are added thereto. Carbonation is resumed at a rate of 15 parts per hour for 2 hours at the methanol reflux temperature. The carbon dioxide addition rate is reduced to 7 parts per hour and the methanol is removed by raising the temperature to about 95° C. over a 3 hour period. An additional 41.5 parts of water are added and carbonation is continued at 7 parts per hour at a temperature of about 90°–95° C. for 3.5 hours. The carbonated mass is then heated to about 150°–160° C. over a 3.5-hour period and then further stripped by reducing the pressure to 20 torr at this temperature. The carbonated reaction product is then filtered. The filtrate is a concentrated oil-solution (31.6% oil) of the desired basic magnesium salt characterized by a metal ratio of 20.

EXAMPLE B-10

To a solution of 790 parts (1 equivalent) of an alkylated benzenesulfonic acid and 71 parts of polybutenyl succinic anhydride (equivalent weight about 560) containing predominantly isobutene units in 176 parts of mineral oil is added 320 parts (8 equivalents) of sodium hydroxide and 640 parts (20 equivalents) of methanol. The temperature of the mixture increases to 89° C. (reflux) over 10 minutes due to exotherming. During this period, the mixture is blown with carbon dioxide at 4 cfh. (cubic feet/hr.). Carbonation is continued for about 30 minutes as the temperature gradually decreases to 74° C. The methanol and other volatile materials are stripped from the carbonated mixture by blowing nitrogen through it at 2 cfh. while the temperature is slowly increased to 150° C. over 90 minutes. After stripping is completed, the remaining mixture is held at 155° 165° C. for about 30 minutes and filtered to yield an oil solution of the desired basic sodium sulfonate having a metal ratio of about 7.75. This solution contains 12.4% oil.

EXAMPLE B-11

Following the procedure of Example B-10, a solution of 780 parts (1 equivalent) of an alkylated benzenesulfonic acid and 119 parts of the polybutenyl succinic anhydride in 442 parts of mineral oil is mixed with 800 parts (20 equivalents) of sodium hydroxide and 704 parts (22 equivalents) of methanol. The mixture is blown with carbon dioxide at 7 cfh. for 11 minutes as the temperature slowly increases to 95° C. The rate of carbon dioxide flow is reduced to 6 cfh. and the temperature decreases slowly to 88° C. over about 40 minutes. The rate of carbon dioxide flow is reduced to 5 cfh. for about 35 minutes and the temperature slowly decreases to 73° C. The volatile materials are stripped by blowing nitrogen through the carbonated mixture at 2 cfh. for 105 minutes as the temperature is slowly increased to 160° C. After stripping is completed, the mixture is held at 160° C. for an additional 45 minutes and then filtered to yield an oil solution of the desired basic sodium sulfonate having a metal ratio of about 19.75. This solution contains 18.7% oil.

EXAMPLE B-12

Following the procedure of Example B-10, a solution of 780 parts (1 equivalent) of an alkylated benzenesulfonic acid and 86 parts of the polybutenyl succinic anhydride in 254 parts of mineral oil is mixed with 480 parts (12 equivalents) of sodium hydroxide and 640 parts (20 equivalents) of methanol. The reaction mixture is blown with carbon dioxide at 6 cfh. for about 5 minutes. During this time the temperature increases to 95° C. and then gradually decreases to 74° C. The volatile material is stripped by blowing with nitrogen gas at 2 cfh. for about one hour as the temperature is increased to 160° C. After stripping is complete the mixture is held at 160° C. for 0.5 hour and then filtered to yield an oil solution of the desired sodium salt, having a metal ratio of 11.8. The oil content of this solution is 14.7%.

EXAMPLE B-13

Following the procedure of Example B-10, a solution of 2800 parts (3.5 equivalents) of an alkylated benzenesulfonic acid and 302 parts of the polybutenyl succinic anhydride in 818 parts of mineral oil is mixed with 1680 parts (42 equivalents) of sodium hydroxide and 2240 parts (70 equivalents) of methanol. The mixture is blown with carbon dioxide for about 90 minutes at 10 cfh. During this period, the temperature increases to 96° C. and then slowly drops to 76° C. The volatile materials are stripped by blowing with nitrogen at 2 cfh. as the temperature is slowly increased from 76° C. to 165° C. by external heating. Water is removed by vacuum stripping. Upon filtration, an oil solution of the desired basic sodium salt is obtained. It has a metal ratio of about 10.8 and the oil content is 13.6%.

EXAMPLE B-14

Following the procedure of Example B-10 a solution of 780 parts (1.0 equivalent) of an alkylated benzenesulfonic acid and 103 parts of the polybutenyl succinic anhydride in 350 parts of mineral oil is mixed with 640 parts (16 equivalents of sodium hydroxide and 640 parts (20 equivalents) of methanol. This mixture is blown with carbon dioxide for about one hour at 6 cfh. During this period, the temperature increases to 95° C. and then gradually decreases to 75° C. The volatile material is stripped by blowing with nitrogen. During stripping, the temperature initially drops to 70° C. over 30 minutes and then slowly rises to 78° C over 15 minutes. The mixture is then heated to 155° C. over 80 minutes. The stripped mixture is heated for an additional 30 minutes 15 155°–160° C. and filtered.

The filtrate is an oil solution of the desired basic sodium sulfonate, having a metal ratio of about 15.2. It has an oil content of 17.1%.

EXAMPLE B-15

Following the procedure of Example B-10, a solution of 780 parts (1 equivalent) of an alkylated bnezenesulfonic acid and 119 parts of the polybutenyl succinic anhydride in 442 parts of mineral oil is mixed well with 800 parts (10 equivalents) of sodium hydroxide and 640 parts (20 equivalents) of methanol. This mixture is blown with carbon dioxide for about 55 minutes at 8 cfh. During this period, the temperature of the mixture increases to 95° C. and then slowly decreases to 67° C. The methanol and water are stripped by blowing with nitrogen at 2 cfh. for about 40 minutes while the temperature is slowly increased to 160° C. After stripping, the temperature of the mixture is maintained at 160°–165° C. for about 30 minutes. The product is then filtered to give a solution of the corresponding sodium sulfonate having a metal ratio of about 16.8. This solution contains 18.7% oil.

EXAMPLE B-16

Following the procedure of Example B-10, 836 parts (1 equivalent) of a sodium petroleum sulfonate (sodium "Petronate") in an oil solution containing 48% oil and 63 parts of the polybutenyl succinic anhydride is heated to 60° C. and treated with 280 parts (7.0 equivalents) of sodium hydroxide and 320 parts (10 equivalents) of methanol. The reaction mixture is blown with carbon dioxide at 4 cfh. for about 45 minutes. During this time, the temperature increases to 85° C. and then slowly decreases to 74° C. The volatile material is stripped by blowing with nitrogen at 1 cfh. while the temperature is gradually increased to 160° C. After stripping is completed, the mixture is heated an additional 30 minutes at 160° C., and then is filtered to yield the sodium salt in solution. The product has a metal ratio of 8.0 and an oil content of 5. 22.2%.

EXAMPLE B-17

To a mixture comprising 125 parts of low viscosity mineral oil and 66.5 parts of heptylphenol heated to about 38° C. there is added 3.5 parts of water. Thereafter, 16 parts of paraformaldehyde are added to the mixture at a uniform rate over 0.75 hour. Then 0.5 parts of hydrated lime are added and this mixture is heated to 80° C. over a 1 hour period. The reaction mixture thickens and the temperature rises to about 116° C. Then, 13.8 parts of hydrated lime are added over 0.75 hour while maintaining a temperature of about 80°–90° C. The material is then heated to about 140° C. for 6 to 7 hours at a reduced pressure of about 2–8 torr to remove substantially all water. An additional 40 parts of mineral oil are added to the reaction product and the resulting material is filtered. The filtrate is a concentrated oil solution (70% oil) of the substantially neutral calcium salt of the heptylphenol-formaldehyde condensation product. It is characterized by calcium content of about 2.2% and a sulfate ash content of 7.5%.

EXAMPLE B-18

A solution of 3192 parts (12 equivalents) of a polyisobutene-substituted phenol, wherein the polyisobutene substituent has a molecular weight of about 175, in 2400 parts of mineral is heated to 70° C. and 502 parts (12 equivalents) of solid sodium hydroxide is added. The material is blown with nitrogen at 162° C. under vacuum to remove volatiles and is then cooled to 125° C. and 465 parts (12 equivalents of 40% aqueous formaldehyde is added. The mixture is heated to 146° C. under nitrogen, and volatiles are finally removed again under vacuum. Sulfur dichloride, 618 parts (6 equivalents), is then added over 4 hours. Water, 1000 parts, is added at 70° C. and the mixture is heated to reflux for 1 hour. All volatiles are then removed under vacuum at 155° C. and the residue is filtered at that temperature, with the addition of a filter aid material. The filtrate is the desired product (59% solution in mineral oil) containing 3.56% phenolic hydroxyl and 3.46% sulfur.

EXAMPLE B-19

A mixture of 319.2 parts (1.2 equivalents) of a tetrapropene-substituted phenol similar to that used in Example B-18, 240 parts of mineral oil and 45 parts (0.6 equivalent) of 40% aqueous formaldehyde solution is heated to 70° C., with stirring, and 100.5 parts (1.26 equivalents) of 50% aqueous sodium hydroxide is added over about 20 minutes, while the mixture is blown with nitrogen. Volatile materials are removed by stripping at 160° C., with nitrogen blowing and subsequently under vacuum. Sulfur dichloride, 61.8 parts (1.2 equivalents), is added below the surface of the liquid at 140°–150° C., over 6 hours. The mixture is then heated at 145° C. for one hour and volatile materials are removed by stripping under nitrogen at 160° C.

The intermediate thus obtained is filtered with the addition of a filter aid material, and 3600 parts (7.39 equivalents) thereof is combined with 1553 parts of mineral oil and 230 parts of the polyisobutenyl succinic anhydride of Example B-2. The mixture is heated to 67° C. and there are added 142 parts of acetic acid, 1248 parts of methanol and 602 parts (16.27. equivalents) of calcium hydroxide. The mixture is digested for a few minutes and then blown with carbon dioxide at 60°–65° C. The carbon dioxide-blown material is stripped at 160° C. to remove volatiles and finally filtered with the addition of a filter aid. The filtrate is the desired product containing 1.68% sulfur and 16.83% calcium sulfate ash.

EXAMPLE B-20

To a mixture of 3192 parts (12 equivalents) of tetrapropenyl-substituted phenol, 2400 parts of mineral oil and 465 parts (6 equivalents) of 40% aqueous formaldehyde at 82° C., is added, over 45 minutes, 960 parts (12 equivalents) of 50% aqueous sodium hydroxide. Volatile materials are removed by stripping as in Example B-18, and to the residue is added 618 parts (12 equivalents) of sulfur dichloride over 3 hours. Toluene, 1000 parts, and 1000 parts of water are added and the mixture is heated under reflux for 2 hours. Volatile materials are then removed at 180° C. by blowing with nitrogen and the intermediate is filtered.

To 1950 parts (4 equivalents) of the intermediate thus obtained is added 135 parts of the polyisobutenyl succinic anhydride of Example B-2. The mixture is heated to 51° C., and 78 parts of acetic acid and 431 parts of methanol are added, followed by 325 parts (8.8 equivalents) of calcium hydroxide. The mixture is blown with carbon dioxide and is finally stripped with nitrogen blowing at 158° C. and filtered while hot, using a filter aid. The filtrate is a 68% solution in mineral oil of the desired product and contains 2.63% sulfur and 22.99% calcium sulfate ash.

EXAMPLE B-21

A reaction mixture comprising about 512 parts by weight of a mineral oil solution containing about 0.5 equivalent of a substantially neutral magnesium salt of an alkylated salicylic acid wherein the alkyl group has an average of about 18 aliphatic carbon atoms and about 30 parts by weight of an oil mixture containing about 0.037 equivalent of an alkylated benzenesulfonic acid together with about 15 parts by weight (about 0.65 equivalent) of a magnesium oxide and about 250 parts by weight of xylene is added to a flask and heated to a temperature of about 60° C. to 70° C. The reaction mass is subsequently heated to about 85° C. and approximately 60 parts by weight of water are added. The reaction mass is held at a reflux temperature of about 95° C. to 100° C. for about 1½ hours and subsequently stripped at a temperature of 155° C.–160° C., under a vacuum, and filtered. The filtrate comprises the basic carboxylic magnesium salt characterized by a sulfated ash content of 12.35% (ASTM D-874, IP 163), indicating that the salt contains 200% of the stoichiometrically equivalent amount of magnesium.

EXAMPLE B-22

A reaction mixture comprising about 506 parts by weight of a mineral oil solution containing about 0.5 equivalent of a substantially neutral magnesium salt of an alkylated salicylic acid wherein the alkyl groups have an average of about 16 to 24 aliphatic carbon atoms and about 30 parts by weight of an oil mixture containing about 0.037 equivalent of an alkylate benzenesulfonic acid together with about 22 parts by weight (about 1.0 equivalent) of a magnesium oxide and about 250 parts by weight of xylene is added to a flask and heated to temperatures of about 60° C. to 70° C. The reaction is subsequently heated to about 85° C. and approximately 60 parts by weight of water are added to the reaction mass which is then heated to the reflux temperature. The reaction mass is held at the reflux temperature of about 95° -100° C. for about 1½ hours and subsequently stripped at about 155° C., under 40 torr and filtered. The filtrate comprises the basic carboxylic magnesium salts and is characterized by a sulfated ash content of 15.59% (sulfated ash) corresponding to 274% of the stoichiometrically equivalent amount.

EXAMPLE B-23

A substantially neutral magnesium salt of an alkylated salicylic acid wherein the alkyl groups have from 16 to 24 aliphatic carbon atoms is prepared by reacting approximately stoichiometric amounts of magnesium chloride with a substantially neutral potassium salt of said alkylated salicylic acid. A reaction mass comprising approximately 6580 parts by weight of a mineral oil solution containing about 6.50 equivalents of said substantially neutral magnesium salt of the alkylated salicylic acid and about 388 parts by weight of an oil mixture containing about 0.48 equivalent of an alkylated benzenesulfonic acid together with approximately 285 parts by weight (14 equivalents) of a magnesium oxide and approximately 3252 parts by weight of xylene is added to a flask and heated to temperatures of about 55° C. to 75° C. The reaction mass is then heated to about 82° C. and approximately 780 parts by weight of water are added to the reaction which is subsequently heated to the reflux temperature. The reaction mass is held at the reflux temperature of about 95°–100° C. for about 1 hour and subsequently stripped at a temperature of about 170° C., under 50 torr and filtered. The filtrate comprises the basic carboxylic magnesium salts and has a sulfated ash content of 15.7% (sulfated ash) corresponding to 276% of the stoichiometrically equivalent amount.

(C) The Sulfurized Olefin Composition

The compositions of the present invention also comprise mixtures of the above-described phosphite esters (A) and the metal overbased salt of an organic acid (B) with (C) at least one sulfurized olefin.

Component C in the compositions of this invention is an extreme pressure agent comprising the sulfurization product of at least one aliphatic or alicyclic olefinic compound containing about 3–30 carbon atoms. The olefinic compounds which may be sulfurized to form component (C) are diverse in nature. They contain at least one olefinic double bond, which is defined as a non-aromatic double bond; that is, one connecting two aliphatic carbon atoms. In its broadest sense, the olefin may be defined by the formula $R^6R^7C{=}CR^8R^9$, wherein each $R^6$, $R^7$, $R^8$ and $R^9$ is hydrogen or an organic radical. In general, the R values in the above formula which are not hydrogen may be satisfied by such groups as $-R^{10}$, $-C(R^{10})_3$, $-COOR^{10}$, $-CON(R^{10})_2$, $-COON(R^{10})_4$, $-COOM$, $-CN$, $$-\overset{\overset{\displaystyle NR^{10}}{\|}}{C}-R^{10}$$

$-X$ or $-YR^{10}$, wherein:

Each $R^{10}$ is independently hydrogen, alkyl, alkenyl, substituted alkyl or substituted alkenyl, with the proviso that any two $R^{10}$ groups can be alkylene or substituted alkylene whereby a ring of up to about 12 carbon atoms is formed;

M is one equivalent of a metal cation (preferably Group I or II, e.g., sodium, potassium, barium, calcium, magnesium);

X is halogen (e.g., chloro, bromo, or iodo);

Y is oxygen or divalent sulfur.

Any two of $R^6$, $R^7$, $R^8$ and $R^9$ may also together form an alkylene or substituted alkylene group; i.e., the olefinic compound may be alicyclic.

The natures of the substituents in the substituted moieties described above are not normally a critical aspect of the invention and any such substituent is useful so long as it is or can be made compatible with lubricating environments and does not interfere under the contemplated reaction conditions. Thus, substituted compounds which are so unstable as to deleteriously decompose under the reaction conditions employed are not contemplated. However, certain substituents such as keto or aldehydo can desirably undergo sulfurization. The selection of suitable substituents is within the skill of the art or may be established through routine testing. Typical of such substituents include any of the above-listed moieties as well as hydroxy, carboxy, carbalkoxy, amidine, amino, sulfonyl, sulfinyl, sulfonate, nitro, phosphate, phosphite, alkali metal mercapto and the like.

The olefinic compound is usually one in which each R value which is not hydrogen is independently alkyl or alkenyl, or (less often) a corresponding substituted radical. Monoolefinic and diolefinic compounds, particularly the former, are preferred, and especially terminal monoolefinic hydrocarbons; that is, those compounds in which $R^8$ and $R^9$ are hydrogen and $R^6$ and $R^7$ are alkyl (that is, the olefin is aliphatic). Olefinic compounds having about 3–30 and especially about 3–20 carbon atoms are particularly desirable.

Propylene, isobutene and their copolymers and oligimers, and mixtures thereof are especially preferred olefinic compounds. Of these compounds, isobutene and diisobutene are particularly desirable because of their availability and the particularly high sulfur-containing compositions which can be prepared therefrom.

The sulfurizing reagent used for the preparation of component C may be, for example, sulfur, a sulfur halide such as sulfur monochloride or sulfur dichloride, a mixture of hydrogen sulfide and sulfur or sulfur dioxide, or a sulfur halide and sodium sulfide, or the like. Sulfur-hydrogen sulfide mixtures are often preferred and are frequently referred to hereinafter; however, it will be understood that other sulfurization agents may, when appropriate, be substituted therefor.

The amounts of sulfur and hydrogen sulfide per mole of olefinic compound are, respectively, usually about 0.3–3.0 gram-atoms and about 0.1–1.5 moles. The preferred ranges are about 0.5–2.0 gram-atoms and about 0.4–1.25 moles respectively, and the most desirable ranges are about 1.2–1.8 gram-atoms and about 0.4–0.8 mole respectively.

The temperature range in which the sulfurization reaction is carried out is generally about 50°–350° C. The preferred range is about 100°–200° C., with about 125°–180° C. being especially suitable. The reaction is often preferably conducted under superatmospheric pressure; this may be and usually is autogenous pressure (i.e., the pressure which naturally develops during the course of the reaction) but may also be externally applied pressure. The exact pressure developed during the reaction is dependent upon such factors as the design and operation of the system, the reaction temperature, and the vapor pressure of the reactants and products and it may vary during the course of the reaction.

It is frequently advantageous to incorporate materials useful as sulfurization catalysts in the reaction mixture. These material may be acidic, basic or neutral, but are preferably basic materials, especially nitrogen bases including ammonia and amines. The amount of catalyst used is generally about 0.05–2.0% of the weight of the olefinic compound. In the case of the preferred ammonia and amine catalysts, about 0.0005–0.5 mole per mole of olefin is preferred, and about 0.001–0.1 mole is especially desirable.

Following the preparation of the sulfurized mixture, it is preferred to remove substantially all low boiling materials, typically by venting the reaction vessel or by distillation at atmospheric pressure, vacuum distillation or stripping, or passage of an inert gas such as nitrogen through the mixture at a suitable temperature and pressure.

A further optional step in the preparation of component (C) is the treatment of the sulfurized product, obtained as described hereinabove, to reduce active sulfur. An illustrative method is treatment with an alkali metal sulfide as described in U.S. Pat. No. 3,498,915. Other optional treatments may be employed to remove insoluble by-products and improve such qualities as the odor, color and staining characteristics of the sulfurized compositions.

U.S. Pat. Nos. 3,926,822 and 4,119,549 are incorporated by reference herein for their disclosures of suitable sulfurization products useful as component (C). Several specific sulfurized compositions are described in the working examples thereof. The following examples illustrate the preparation of two such compositions.

EXAMPLE C-1

A mixture of 100 parts of soybean oil, 5.25 parts of tall oil acid and 44.8 parts of commercial $C_{15-18}$ straight-chain a-olefins is heated to 167° C. under nitrogen, and 17.4 parts of sulfur is added. The temperature of the mixture rises to 208° C. Nitrogen is blown over the surface at 165°–200° C. for 6 hours and the mixture is then cooled to 90° C. and filtered. The filtrate is the desired product and contains 10.6% sulfur.

EXAMPLE C-2 sulfur (629 parts, 19.6 moles) is charged to a jacketed high-pressure reactor which is fitted with an agitator and internal cooling coils. Refrigerated brine is circulated through the coils to cool the reactor prior to the introduction of the gaseous reactants. After sealing the reactor, evacuating to about 6 torr and cooling, 1100 parts (19.6 moles) of isobutene, 334 parts (9.8 moles) of hydrogen sulfide and 7 parts of n-butylamine are charged to the reactor. The reactor is heated using steam in the external jacket, to a temperature of about 171° C. over about 1.5 hours. A maximum pressure of 720 psig. is reached at about 183° C. during this heat-up. Prior to reaching the peak reaction temperature, the pressure starts to decrease and continues to decrease steadily as the gaseous reactants are consumed. After about 4.75 hours at about 171° C., the unreacted hydrogen sulfide and isobutene are vented to a recovery system. After the pressure in the reactor has decreased to atmospheric, the sulfurized mixture is recovered as a liquid.

As previously indicated, the compositions of this invention are useful as additives for lubricants, in which they function primarily as extreme pressure and antiwear agents having a relatively long period of effectiveness. They can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like. Automatic transmission fluids, transaxle lubricants, gear lubricants (in which their use is especially beneficial), metal-working lubricants, hydraulic fluids and other lubricating oil and grease compositions can also benefit from the incorporation therein of the compositions of the present invention.

Natural oils include animal oils and vegetable oils (e.g., castor oil, lard oil) as well as liquid petroleum oils and solvent-treated or acid-treated mineral lubricating oils of the paraffinic, naphthenic and mixed paraffinic-naphthenic types. Oils of lubricating viscosity derived from coal or shale are also useful base oils. Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes), etc. and mixtures thereof); alkylbenzenes (e.g., dodecylbenzenes, tetradecylbenzenes, dinonylbenzenes, di(2-ethylhexyl)benzenes, etc.); polyphenyls (e.g., biphenyl, terphenyls, alkylated polyphenyls, etc.), alkylated diphenyl ethers and alkylated polyphenyls, etc.), alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic lubricating oils. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500, etc.) or mono-and polycarboxylic esters thereof, for example, the acetic acid esters, mixed $C_3$–$C_8$ fatty acid esters, or the $C_{1-3}$Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diiosoctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra- (2-ethylhexyl) silicate, tetra- (4-methyl-2-ethylhexyl) silicate, tetra- (p-tert-butylphenyl) silicate, hexa- (4-methyl-2-pentoxy) -disiloxane, poly (methyl) siloxanes-, poly(methylphenyl)siloxanes, etc.). Other synthetic lubricating oils include liquid esters of phosphorus-containing acids (e.g., tricresyl phosphate, trioctyl phosphate, diethyl ester of decylphosphonic acid, etc.), polymeric tetrahydrofurans and the like.

Unrefined, refined and rerefined oils (and mixtures of each with each other) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

The compositions of the present invention also comprise mixtures of the above-described phosphite esters (A) and the metal overbased compositions (B) with (C), a sulfurized olefin composition. In a blend that contains a lubricating base oil, (A), (B) and (C) are generally present in the following levels: (A) at a phosphorus level from about 0.01% up to about 1%; (B) at a total base number level from about 0.1 up to about 10; and (C) at a sulfur level from about 0.01% up to about 5%. Preferably the % phosphorus level of (A), the total base number of (B) and the % sulfur level of (C) are 0.025 to 0.75, 1 to 7.5 and 0.1 to 3.5 respectively. Most preferably these levels are 0.05 to 0.5, 2 to 5 and 0.25 to 2 respectively.

A 100 part blend that contains a lubricating oil, (A) at 0.05% phosphorus of example A-4, (B) 5 total base numbers of example B-3 and (C) 2 % sulfur of example C-1 will contain 79,488 parts lubricating oil, 0.352 parts example A-4, 1.292 parts example B-3 and 18,868 parts example C-1.

The invention also contemplates the use of other additives in combination with the compositions of this invention. Such additives include, for example, detergents and dispersants of the ash-producing or ashless type, corrosion- and oxidation-inhibiting agents, pour point depressing agents, auxiliary extreme pressure agents, color stabilizers, friction modifiers and anti-foam agents.

The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature above 50° C. and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl-B-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°–200° C.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

| | | |
|---|---|---|
| 3,163,603 | 3,351,552 | 3,522,179 |
| 3,184,474 | 3,381,022 | 3,541,012 |
| 3,215,707 | 3,399,141 | 3,542,678 |
| 3,219,666 | 3,415,750 | 3,542,680 |
| 3,271,310 | 3,433,744 | 3,567,637 |
| 3,281,357 | 3,444,170 | 3,574,101 |
| 3,306,908 | 3,448,048 | 3,576,743 |
| 3,311,558 | 3,448,049 | 3,630,904 |
| 3,316,177 | 3,451,933 | 3,632,510 |
| 3,340,281 | 3,454,607 | 3,632,511 |
| 3,341,542 | 3,467,668 | 3,697,428 |
| 3,346,493 | 3,501,405 | 3,725,441 |
| | | Re 26,433 |

(2) "Amine dispersants" and "Mannich dispersants" such as those described hereinabove.

(3) Products obtained by post-treating the carboxylic, amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |

(4) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. patents:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

Auxiliary extreme pressure agents and corrosion- and oxidation-inhibiting agents are exemplified by chlorinated aliphatic hydrocarbons such as chlorinated wax; aromatic or arylaliphatic sulfides and polysulfides such as benzyl disulfide, bis(chlorobenzyl)disulfide and sulfurized alkylphenol; phosphosulfurized hydrocarbons such as the reaction product of a phosphorus sulfide with turpentine or methyl oleate; phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, dioctylphosphorodithioate, barium di(heptylphenyl)phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

The compositions of this invention can be added directly to the lubricant. Preferably, however, they are diluted with a substantially inert, normally liquid organic diluent such as mineral oil, naphtha, benzene, toluene or xylene, to form an additive concentrate which usually contains about 20–90% by weight of said composition and may contain, in addition, one or more other additives known in the art or described hereinabove.

What is claimed is:

1. A composition free of Group II metal phosphorodithioates useful as a gear oil lubricant comprising a lubricating base oil having dissolved therein a combination of (A) at least one phosphite ester characterized by the formula

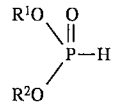

wherein each of $R^1$ and $R^2$ is independently a hydrocarbyl based group containing from 4 to 12 carbon atoms;

(B) at least one magnesium overbased sulfonate; and (C) at least one sulfurization product of an aliphatic olefinic compound containing from 3 to 30 carbon atoms.

2. The composition of claim 1 wherein each of $R^1$ and $R^2$ is an alkyl group.

3. The composition of claim 1 wherein each of $R^1$ and $R^2$ is independently an alkyl group containing from 8 to 10 carbon atoms.

4. The composition of claim 1 wherein (B) the magnesium overbased sulfonate is derived from an alkylated aryl sulfonic acid wherein the alkyl group has at least 15 aliphatic carbon atoms.

5. The composition of claim 1 wherein the magnesium overbased sulfonate is treated with a borating agent.

6. The composition of claim 1 Wherein (C) is derived from an olefinic compound selected from the group consisting of propylene, isobutylene, copolymers and oligomers, and mixtures thereof.

7. The composition of claim 6 wherein the sulfurization agent is selected from the group consisting of sulfur, hydrogen sulfide, and mixtures thereof.

8. The composition of claim 6 wherein the sulfurization agent is selected from the group consisting of sulfur monochloride, sulfur dichloride, sodium sulfide, and mixtures thereof.

9. The composition of claim 1 wherein (C) the sulfurization product is prepared by reacting, at temperatures ranging from about 50° C. to about 350° C., under autogenous pressure, from about 0.3–3.0 gram-atoms of sulfur and 0.1–1.5 moles of hydrogen sulfide per mole of aliphatic olefinic compound in the presence of a basic sulfurization catalyst.

10. The composition of claim 4 wherein the alkylated aryl sulfonic acid is an alkylated benzene sulfonic acid.

11. The composition of claim 1 wherein the sulfonic acid is a petroleum sulfonic acid.

* * * * *